United States Patent [19]

Juhas

[11] Patent Number: 4,904,538

[45] Date of Patent: Feb. 27, 1990

[54] ONE STEP HIP CANNING OF POWDER METALLURGY COMPOSITES

[75] Inventor: John J. Juhas, Columbia Station, Ohio

[73] Assignee: The United States of America as represented by the Administrator of the National Aeronautics and Space Administration, Washington, D.C.

[21] Appl. No.: 326,757

[22] Filed: Mar. 21, 1989

[51] Int. Cl.[4] ..... B22F 3/00

[52] U.S. Cl. ..... 428/552; 75/228; 428/551; 419/8; 419/24; 419/36; 419/37; 419/48; 419/49; 419/54; 419/60

[58] Field of Search ..... 75/228; 428/551, 552; 419/8, 24, 36, 37, 48, 49, 54, 60

[56] References Cited

U.S. PATENT DOCUMENTS

| | | | |
|---|---|---|---|
| 3,714,702 | 2/1973 | Hammond | 29/494 |
| 3,940,268 | 2/1976 | Catlin | 419/49 |
| 4,104,782 | 8/1978 | Veeck et al. | 29/527.2 |
| 4,110,131 | 8/1978 | Gessinger | 148/11.5 N |
| 4,212,669 | 7/1980 | Veeck et al. | 75/226 |
| 4,335,192 | 6/1982 | Oliapuram | 419/37 |
| 4,448,747 | 5/1984 | Moritoki et al. | 419/49 |
| 4,526,747 | 7/1985 | Schimmel et al. | 419/8 |
| 4,554,130 | 11/1985 | Ecer | 419/8 |
| 4,587,096 | 5/1986 | Mankins et al. | 419/37 |
| 4,599,215 | 7/1986 | Smarsly et al. | 419/42 |
| 4,673,549 | 6/1987 | Ecer | 419/10 |

*Primary Examiner*—Stephen J. Lechert, Jr.
*Attorney, Agent, or Firm*—Gene E. Shook; James A. Mackin; John R. Manning

[57] ABSTRACT

A single step is relied on in the canning process for hot isostatic pressing powder metallurgy composites. The binders are totally removed while the HIP can of compatible refractory metal is sealed at high vacuum and temperature. This eliminates out-gassing during hot isostatic pressing.

14 Claims, 3 Drawing Sheets

ONE STEP HIP CANNING OF POWDER METALLURGY COMPOSITES

ORIGIN OF THE INVENTION

The invention described herein was made by an employee of the United States Government and may be manufactured and used by or for the Government for governmental purposes without the payment of any royalties thereon or therefor.

TECHNICAL FIELD

This invention is directed to an improved process for canning powder metallurgy composites. The invention is particularly concerned with a single step method of canning binder containing powder metallurgy composites for hot isostatic pressing (HIP).

One conventional method for canning a specimen for hot isostatic pressing is to lay up the specimen in a refractory metal can that is completely welded shut, except for a small opening. The can is then heated in a furnace under vacuum to a temperature sufficient to burn off the binders. These binders keep the powder and fiber layers in their proper positions in the composite. The binders must be totally removed to continue the processing. The can is then cooled and removed from the furnace. The can is then electron beam welded closed to seal the composite in a vacuum.

The main disadvantage to this process is that it will not produce a useable composite specimen. As the binders are burned off in the vacuum furnace, the materials inside become loose powder and fiber with nothing to hold them in place. The shifting of these materials during the remaining processing destroys the geometry of the composite.

In an effort to solve these problems, a two-step process has been suggested. The specimen is placed in an open channel die which is positioned in a vacuum hot press. This assembly is heated under vacuum to burn off the binders, and it is pressed to partially densify the specimen. Upon removal from the press the sample is placed in a refractory metal can and electron beam welded to seal in a vacuum.

This two-step process produces powder metallurgy specimens, but a number of disadvantages are encountered: The time and cost are greater because the process uses a plurality of steps. The vacuum in the can is sealed in at room temperature, and the subsequent heating in the HIP operation can produce out-gassing in a canned specimen resulting in poor densification. Because the can must be electron beam welded there is a potential for cracks in the weld caused by recrystallization of the refractory metal in the heat affected weld zone. This cracking of the weld prevents the specimen from densifying in the HIP operation.

Another disadvantage of the two-step process is the HIP cans must be formed to the approximate size of the specimen. An adequate fit cannot be assured because of variations in the specimen dimensions. As deformation of the can occurs in the HIP operation, uneven stresses can occur causing warping of the specimen.

It is, therefore, an object of the present invention to provide a one step, ideal, and economical method of canning binder containing powder metallurgy composites for hot isostatic pressing.

BACKGROUND ART

Veeck et al U.S. Pat. Nos. 4,104,782 and 4,212,669 disclose methods for consolidating precision shapes wherein powder particles are consolidated into shaped porous preforms. Coatings are applied to these preforms which are degasified by a vacuum at elevated temperatures. The coated preforms are heated under a vacuum to a temperature such that the coating is densified to the extent that it becomes non-porous.

Gessinger U.S. Pat. No. 4,110,131 describes the powder metallurgic production of a high temperature alloy body. Moritoki et al U.S. Pat. No. 4,448,747 discloses a high density sintering method for powder molded products wherein the products are loaded into a heating furnace. Preliminary sintering of the products takes place in the furnace while the furnace is located in a chamber under vacuum.

Ecer U.S. Pat. No. 4,554,130 describes a method of consolidation of a part from separate metallic components. A binder is burned off at elevated temperatures, and pressure is used to consolidate the powdered metal. Ecer U.S. Pat. No. 4,673,549 discloses a method for the manufacture of objects by the consolidation of powdered metals and the like. A metal or ceramic can holds a shaped shell. The shell as well as the space between the shell and can are both filled with powder. The can is then out-gassed and sealed. Pressing is used to consolidate the powder into a dense form.

Smarsly et al U.S. Pat. No. 4,599,215 discloses a method for producing compressed moldings from loose or sintered metal powder. A flow die is compressed in a cavity block to thereby compress metal powder contained in a hermetically sealed capsule.

DISCLOSURE OF THE INVENTION

The objects of the inventions are achieved by a single step hot isostatic pressing (HIP) canning of powder metallurgy composite specimens wherein each specimen is placed inside of a refractory metal ring and sandwiched between two refractory metal sheets. The resultant assembly is placed in a die which is loaded in a hot vacuum press.

The specimen is heated in the vacuum to a temperature sufficient to burn off binders. This temperature is then raised when all the binder is burned off, and a pressing load is applied to produce deformation of the refractory metal ring and a solid state diffusion weld between the ring and the face sheets. The deformation continues until the composite specimen partially densifies, thereby locking the specimen geometry in place. The resultant can is then used in a further HIP operation to complete densification of the specimen.

DESCRIPTION OF THE DRAWINGS

The objects, advantages and novel features of the invention will be more fully apparent from the following detailed description when read in connection with the accompanying drawings wherein like numerals are used throughout to identify like parts.

DETAILED DESCRIPTION OF THE INVENTION

Figure 1:
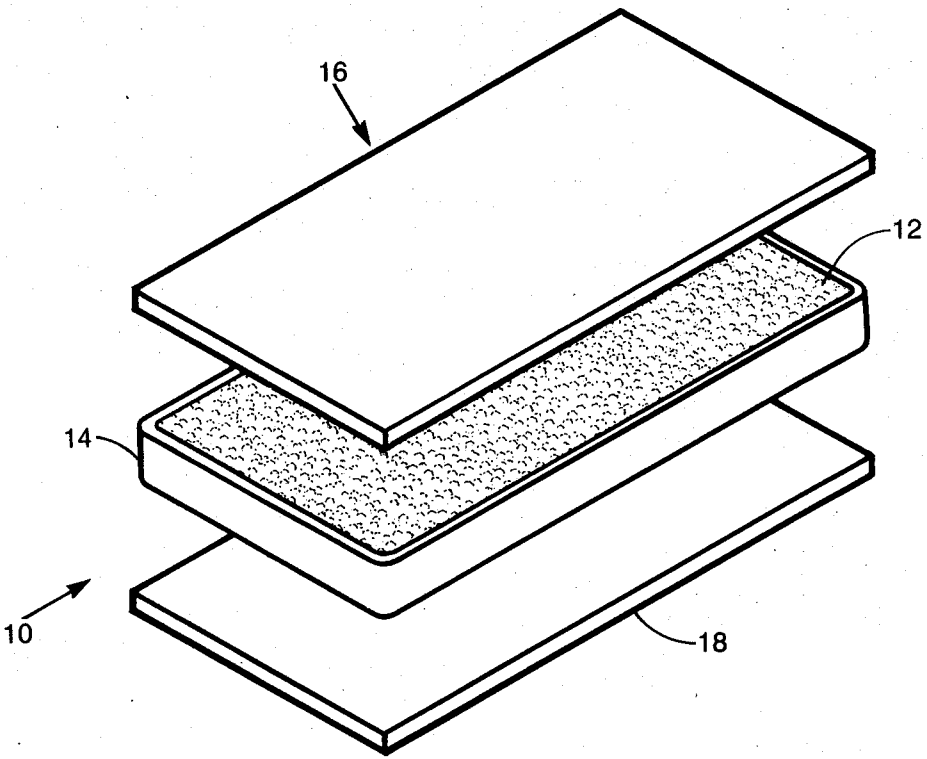
FIG. 1 is a perspective view showing a specimen assembled with the required component parts of the present invention.

Referring now to FIG. 1 there is shown an assembly 10 formed in accordance with the present invention. A specimen 12 comprising layers of fibers and powders held together with binders is positioned within a metal ring or frame 14 which is interposed between a pair of face sheets 16 and 18. The ring 12 and the face sheets 14 and 16 are of a refractory metal.

Figure 2:
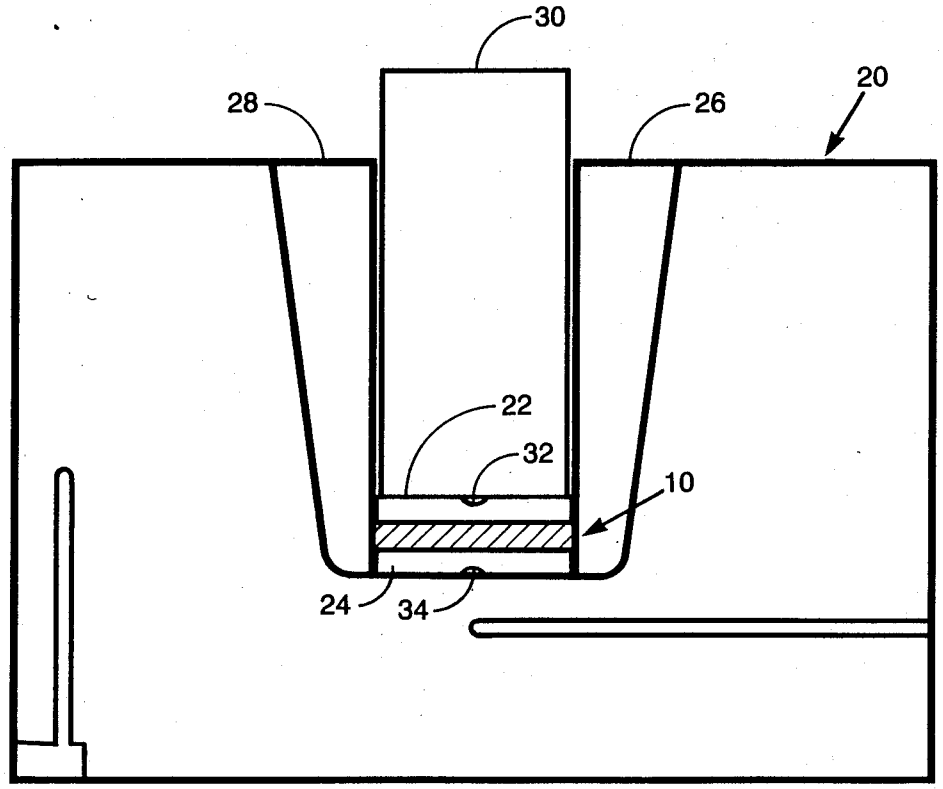
FIG. 2 is a schematic view showing the assembly of FIG. 1 positioned in a channel die.

The assembly 10 is placed in a molybdenum channel die 20 as shown in FIG. 2. More particularly, the specimen assembly 10 is positioned between a pair of pressure plates 22 and 24 that are located between a pair of spaced knockout wedges 26 and 28.

A punch 30 is mounted for reciprocating motion between the wedges 26 and 28. The outermost end of the punch 30 engages the surface of the pressure plate 22 that is opposite the face which engages the specimen assembly 10. A thermocouple 32 is provided in the pressure plate 22, while a similar thermocouple 34 is mounted in the opposite pressure plate 24.

Figure 3:
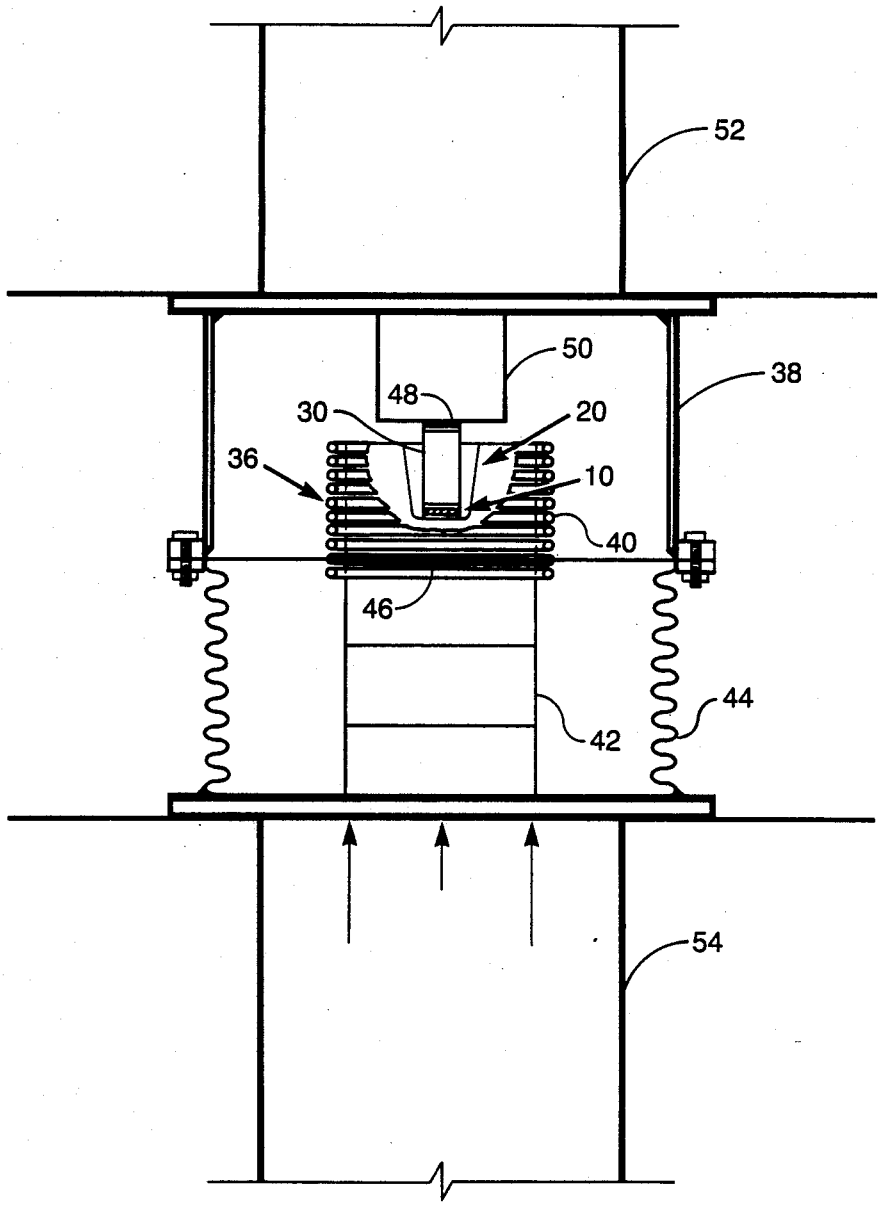
FIG. 3 is a schematic view showing the die of FIG. 2 positioned in a hot vacuum press.

The channel die 20 with the specimen assembly 10 therein is mounted in a hot press 36 that is contained in a vacuum chamber 38 as shown in FIG. 3. More particularly, the hot press 36 utilizes an induction coil 40 which surrounds the die 20 that is supported by a molybdenum pedestal 42. A stainless steel bellows 44 encircles the pedestal 42 to maintain the vacuum environment.

Insulation 46 in the form of zirconia sheets thermally isolates the die 20 from the pedestal 42. Likewise, insulation 48 in the form of similar ziroconia sheets thermally isolates the punch 20 from a steel ram 50 on a press 52. The pedestal 42 is carried by base 54 which is opposite the press 52. This base is capable of supporting loads up to 250,000 lbs. as indicated by the arrows in FIG. 3.

The specimen assembly 10 is heated in the vacuum 38 by the coils 40 to a temperature sufficient to burn off the binders in the specimen 12. When all the binder is burned off the temperature is raised and a load is applied by the press 52 through the steel ram 50 and punch 30.

The force of this load causes deformation of the refractory metal ring 14, and a solid state diffusion weld occurs between the ring 14 and the face sheets 16 and 18. This deformation continues until the composites specimen 12 partially densifies. This locks the fibers and powders in place thereby establishing the specimen geometry.

A perfectly fitted HIP can sealed at high temperature and vacuum has been created. The optimum situation now exists to complete the densification of the specimen by HIPPING.

It will be appreciated by those skilled in the art that the novel process provides for the total removal of binders in the powder metallurgy composite and the sealing in the HIP can of compatible refractory metal in a single operation. This eliminates the extra cost of forming and electron beam welding separate HIP cans.

Also, the HIP cans are sealed at high vacuum and at high temperature thereby no out-gassing will occur during the HIP process. This is important as out-gassing inside the can would prevent complete densification and could cause interstitial contamination leading to embrittlement of the specimen. The geometry and uniformity of the specimen are maintained due to the optimum fitting HIP can. This prevents specimen warpage caused by uneven stresses that can occur in conventional HIP canning procedures.

Because it is not necessary to electron beam weld the HIP can, recrystallization of the weld area does not occur. This eliminates the possibility of a cracking failure of the can. The cost and labor of duplicating failed specimens are saved.

While the preferred embodiment of the invention has been shown and described, it will be appreciated in various structural and procedurial modifications may be made without departing from the spirit of the invention and the scope of the subjoined claims. By way of example, because of compatibility differences between specimen material and the rings and face sheets, different refractory materials can be used with the equal success. Moreover, it is contemplated the process can be used for other materials beside powder metallurgy composites, such as arc spray or plasma spray monotapes, where high vacuum and high temperature sealing of HIP cans to minimize interstitial contamination is beneficial.

I claim:

1. A method of canning a powder metallurgy composite containing binders prior to hot isostatic pressing comprising the steps of enclosing said composite with a metal frame adjacent the outer peripheral surface thereof, interposing said composite and frame between spaced face sheets to form an assembly, positioning said assembly in a die, loading said die and assembly into a vacuum hot press, heating said composite in a vacuum to a first temperture that is high enough to remove said binders, maintaining said composite at said first temperature in said vacuum until substantially all of said binders are removed, heating said composite to a second temperature that is substantially higher than said first temperature subsequent to the removal of said binders, maintaining said composite at said second temperature while deforming said frame and producing a solid state diffusion weld between said frame and said face sheets, and partially densifying said composites thereby establishing the geometry of the same.

2. A method of canning a powder metallurgy composite as claimed in claim 1 wherein said frame comprises a refractory metal ring.

3. A method of canning a powder metallurgy composite as claimed in claim 2 wherein said frame is deformed by applying a pressure load to said die.

4. In a method of hot isostatic pressing a metallurgy composite comprising layers of fibers and powders held together with binders, an improved canning process including removing said binders by heating said composite between face plates separated by a frame that surrounds said fibers and powders, and heating said composite in a vacuum to a higher temperature at which the frame is deformed and a solid state diffusion weld is produced between said face plate and said frame thereby partially densifying said composite to lock the fibers and powders in place in a can.

5. A method of hot isostatic pressing and a metallurgy composite as claimed in claim 4 wherein said frame and said face plates are metal.

6. A method of hot isostatic pressing a metallurgy composite as claimed in claim 5 wherein said frame and face sheets are a refractory metal.

7. A method of hot isostatic pressing a metallurgy composite as claimed in claim 4 wherein the frame is deformed and the solid state diffusion weld is formed by applying a pressure load to said face plates.

8. A method of hot isostatic pressing a metallurgy composite as claimed in claim 7 wherein the pressure load is applied to a die carrying said composite.

9. In a method of hot isostatic pressing a powder metallurgy composite containing binders, an improved canning process comprising enclosing said composite in a can, and removing said binders in said composite while simultaneously sealing said can so that no out-gassing will occur during hot isostatic pressing.

10. An improved method as claimed in claim 9 including heating the composite in a vacuum to a first temperature that is high enough to remove the binders, and maintaining said composite at said first temperature in said vacuum until substantially all of said binders are removed.

11. An improved method as claimed in claim 10 including heating the composite to a second temperature substantially higher than said first temperature subsequent to the removal of the binders, and maintaining said composite at said second temperature while sealing said can and partially densifying said composite.

12. An improved method as claimed in claim 11 including deforming the can at the second temperature to produce a solid state diffusion weld around said composite.

13. An improved method as claimed in claim 12 wherein the can is deformed by applying a pressure load.

14. A composite formed in accordance with the method of claim 9.

* * * * *